US006905089B1

(12) United States Patent
Solis et al.

(10) Patent No.: US 6,905,089 B1
(45) Date of Patent: Jun. 14, 2005

(54) GUIDE AND BRAKE SYSTEM FOR WIRE REEL TERMINAL HOLDER

(75) Inventors: Hector M. Solis, Newport Beach, CA (US); Robert S. Zapata, Whittier, CA (US)

(73) Assignee: SOL Telecommunications Services INC, Santa Fe Springs, CA (US)

( * ) Notice: Subject to any disclaimer, the term of this patent is extended or adjusted under 35 U.S.C. 154(b) by 20 days.

(21) Appl. No.: 10/805,827

(22) Filed: Mar. 22, 2004

(51) Int. Cl.[7] ..... B65H 49/20; B65H 59/04

(52) U.S. Cl. ..... 242/421.8; 242/557; 242/594.3; 242/594.5

(58) Field of Search ..... 242/421.8, 421.9, 242/557, 594.5, 594.3, 156, 156.2, 129.8

(56) References Cited

U.S. PATENT DOCUMENTS

| | | | | |
|---|---|---|---|---|
| 1,418,706 A | | 6/1922 | Hampton | |
| 1,908,073 A | | 5/1933 | Spoor et al. | |
| 3,069,107 A | | 12/1962 | Hirt | |
| 3,351,302 A | * | 11/1967 | Lang | 242/156.2 |
| 3,618,870 A | | 11/1971 | Martin et al. | |
| 3,648,948 A | * | 3/1972 | Level | 242/156 |
| 3,796,392 A | | 3/1974 | Starace | |
| 3,912,191 A | * | 10/1975 | Anderson et al. | 242/421.8 |
| 4,124,176 A | | 11/1978 | Carlson et al. | |
| 4,742,973 A | | 5/1988 | Stomski et al. | |
| 2002/0003184 A1 | | 1/2002 | Shibazaki et al. | 242/421.8 |
| 2003/0015619 A1 | * | 1/2003 | Tipton et al. | 242/421.8 |

* cited by examiner

*Primary Examiner*—John M. Jillions
(74) *Attorney, Agent, or Firm*—James G O'Neill; Klein O'Neill & Singh, LLP

(57) ABSTRACT

A wire reel mounted on a support having a pivoting brake arm with improved brake pads at one end and an enclosed eyelet at a second end. A separate L-bar is also mounted on the support and includes an eyehook aligned with the eyelet to further smoothly guide the wire being withdrawn from the reel. A number of wire reels having pivoting brake arms and L-bars may be rotatably mounted on the support. The support may take the form of a movable cart with a number of reels rotatably mounted on a top surface.

20 Claims, 4 Drawing Sheets

GUIDE AND BRAKE SYSTEM FOR WIRE REEL TERMINAL HOLDER

BACKGROUND OF THE INVENTION

1. Field of the Invention

This invention generally relates to wire reels, and more particularly, to an improved guide and brake system for a wire reel that is sized and dimensioned to more smoothly feed and more efficiently brake wire being pulled from a reel.

2. Description of the Prior Art

Many types of wire reels are known for use in telephone exchanges and other similar areas to store wire for use in the areas. These known wire reels have problems pulling the wire off the reel because of overruns that cause entanglement, dragging of wire, rubbing off of insulation, and the like. In attempts to control overruns from such reels, many different types of braking and guiding systems have been developed over the years. Examples of such known systems are set forth in U.S. Pat. No. 1,418,706 to Hampton, U.S. Pat. No. 1,908,073 to Spoor et al., U.S. Pat. No. 3,069,107 to Hirt, U.S. Pat. No. 3,618,870 to Martin, U.S. Pat. No. 3,796,392 to Starace, U.S. Pat. No. 4,124,176 to Carlson et al. and U.S. Pat. No. 4,742,973 to Stomski et al.

The known reels and their associated braking and guide systems have been developed for specific situations and improve the pulling of wire in such situations. However, they do not work well in all instances or with all wires. For example, they do not always accurately control and guide some wires, such as insulated wires, when the wire is being pulled off a reel during varying short and long runs.

Therefore, there exists a long felt need in the wire reel art for an improved system for more accurately and smoothly guiding wire being pulled from a reel with less wear and tear on the wire, and which provides more efficient braking of the wire during and after a run of any desired length.

SUMMARY OF THE INVENTION

Accordingly, it is a general object of the present invention to provide an improved wire reel feeding system. It is a more particular object of the present invention to provide an improved wire reel brake and guide system. It is a further particular object of the present invention to provide an improved wire reel feeding system having separate and distinct braking and guide systems to more accurately control and regulate the unreeling of wire from the reel. It is yet another particular object of the present invention to provide an improved wire reel feeding system having separate brake and guiding systems specifically sized and dimensioned to cause less wear and tear on wire being pulled from a reel. And, it is still a further particular object of the present invention to provide an improved wire reel having improved brakes mounted on a leverage bar having an initial wire guide therein and a separate L-bar having an eyehook attached to the reel, in a specific spaced relationship for smoothly guiding wire of any length being pulled from the reel.

In accordance with one aspect of the present invention there is provided a wire reel system having improved brake pads on one end of a rocking brake arm with an enclosed eyelet formed at a second end. A separate L-bar having an eyehook to further guide the wire is provided at a specifically designed distance from the eyelet in the brake bar, to smoothly guide the wire being withdrawn from the reel.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel and improved reel brakes and wire guides for a wire reel terminal holder.

The wire reel brake and guide system of the present invention is generally indicated throughout the drawings at 10. The system 10 of the present invention provides a wire reel with an improved reel brake and wire guide in a system that is specifically sized and dimensioned to more smoothly feed and more efficiently brake wire being pulled from the wire reel, no matter what the length or the run of wire being pulled. The system 10 is particularly useful during long pulls or runs for wire reels in telephone exchanges.

Figure 1:
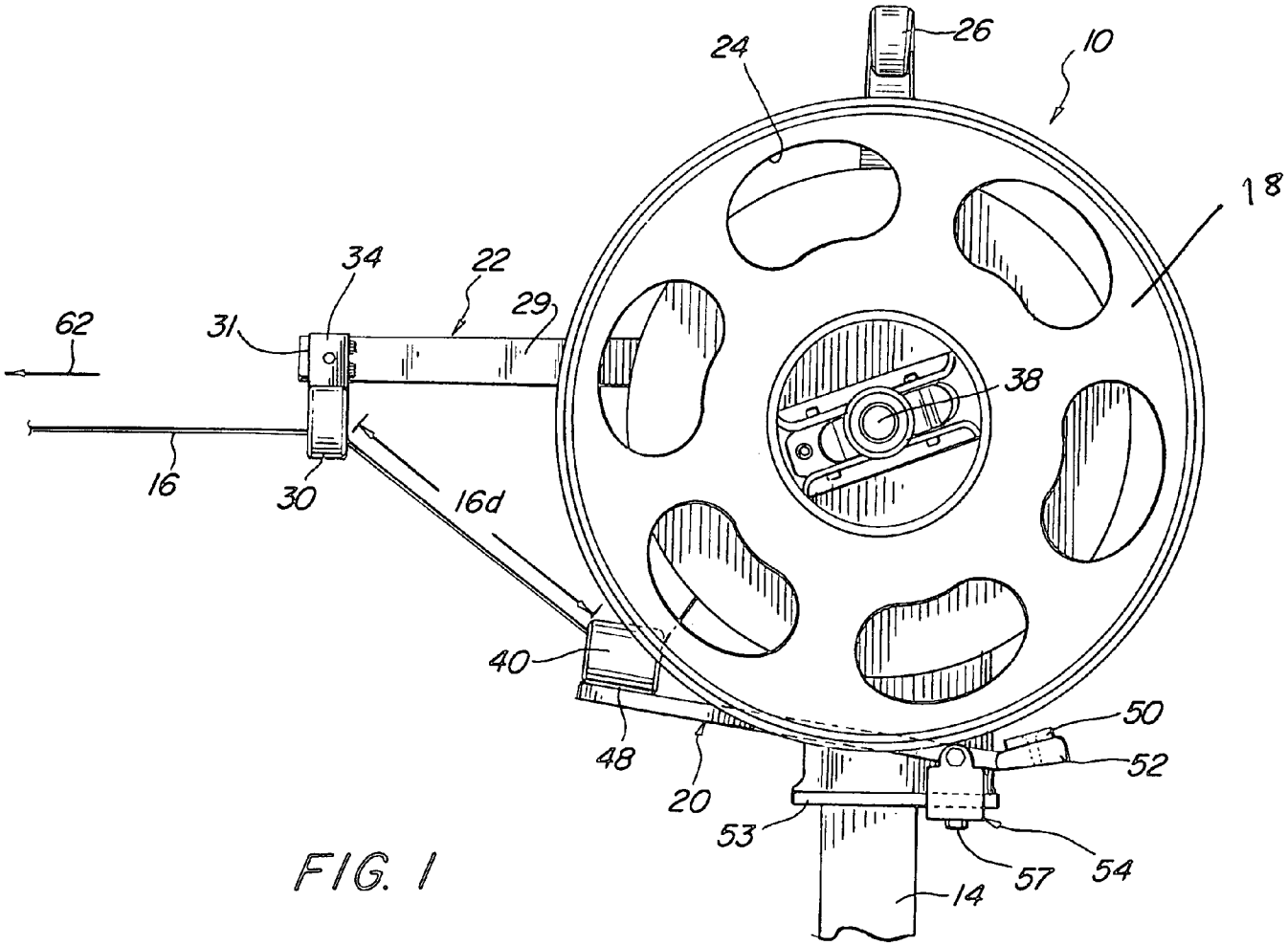
FIG. 1 is a side elevational view of a preferred embodiment of wire reel feeding system of the present invention having a novel reel brake and wire guide.

Turning first to FIG. 1 of the drawings, the system 10 of the present invention uses a wire reel 12 of any desired size, but which is preferably a 16 inch reel of the type used in telephone exchanges. The wire reel 12 is rotatably carried or mounted on any desired mount 14, such as an arm support bracket, carrier, column, or the like, in a manner well known to those skilled in the art. Wire 16 is wrapped around a hub of the wire reel 12 and held between sides 18 of the reel. When needed, the wire 16 is pulled from the wire reel 12 after being fed through a brake arm 20 and a wire guide 22, specifically sized and dimensioned to provide the best possible results. The sides 18 of the wire reel 12 are shown as having specifically formed openings 24 therein, in order to view the amount of wire remaining on the hub of the reel. The wire reel 12 may be provided with a handle 26 for ease in carrying the same.

Figure 2:
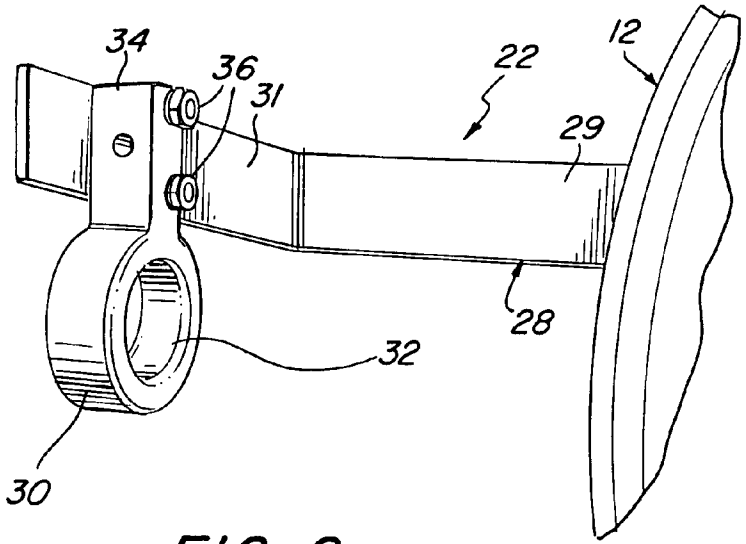
FIG. 2 is a perspective view of the wire guide of FIG. 1.

As best shown in FIG. 2, the wire guide 22 includes an L-shaped support bar 28 securely fastened to the mount 14 (see FIG. 1), in any desired manner, by a longer arm 29. An eyehook 30 having a smooth bore opening 32 formed extending therethrough is securely held or mounted on a shorter arm 31, as by means of holding arm or element 34, fastened to the shorter arm by means of securing elements 36, such nuts and bolts or screws. The L-shaped support bar 28 is sized and dimensioned so as to place the opening 32 aligned with a central hub 38 of the reel 12 along axis 40 (see FIG. 1), substantially centrally located between the sides 18. In a currently preferred embodiment of the invention the L-shaped bar is about ¼" thick with the longer arm about 16" long, the shorter arm about 7" long and the eyehook about ¾" thick with an opening about ⅞" in diameter with a ½" thick surrounding wall.

Figure 3:
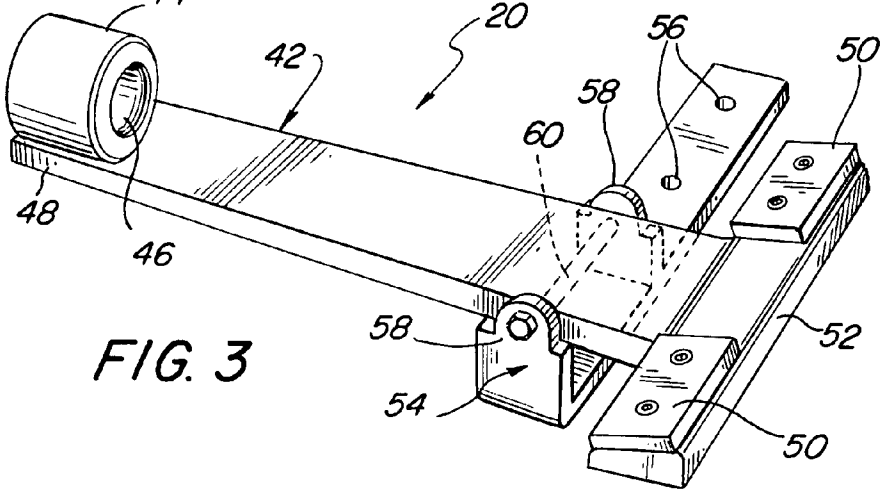
FIG. 3 is a perspective view of the reel brake of FIG. 1.

As best shown in FIGS. 1 and 3, the reel brake 20 is pivotably mounted on the mounting means 14 and includes a body 42 having an eyelet 44 with a smooth opening 46 at a first end 48 and a pair of brake pads 50, for engaging the outer edges of the sides 18, at a second end 52. The second end 52 preferably forms a T with the body 42 and extends perpendicularly outwardly from both side edges of the body for a predetermined distance, depending on the thickness of the wire reel 12 and the spacing of the sides 18. The body 12 is mounted on a base 54 secured to the mounting means 14 in any desired manner, as by means of one or more holding elements 57 (see FIG. 1) passing through openings 56 into a holding bracket or portion 53 on the mounting means 14. The base 54 preferably includes a pair of spaced perpendicular walls 58 having openings formed therein to hold a pivot pin 60 passing through an opening formed in the body 42, adjacent the second end 52. The opening through the body 42 is preferably formed adjacent the second end 52, to allow the body to pivot or rock about pivot pin 60 to move the brake pads 50 into and out of contact with the outer edges of the sides 18. In a currently preferred embodiment of the invention the reel brake is about ⅝" thick with the second end being about 7¼" long and the eyelet being about 1¾" thick or long with an opening about ⅞" in diameter and a ½" thick surrounding wall.

As shown in FIG. 1, when the wire 16 is being pulled in the direction of arrow 62, because it passes through opening 46 in eyelet 44 and the opening 32 in the eyehook 30, it will pivot or rock the first end 48 of the reel brake 20 upwardly so as to move the second end 52 and brake pads 50 away from the outer edges of the sides 18 of the reel 12 to allow the reel to freely rotate. However, when the force applied against the wire 16 ends, i.e., the pulling is stopped, the first end 48 will move or pivot downwardly, away from the reel 12, thereby moving the second end 52 and brake pads 50 upwardly, toward the reel and into contact with the outer edges of the sides 18 to thereby stop rotation of the reel.

The reel brake 20 and wire guide 22 are specifically sized and dimensioned and held in position on the support arm 14 so that when the wire 16 is being pulled in the direction of arrow 62 the distance between the eyelet 44 and eyehook 32, as shown at 16*d* in FIG. 1, is between about 9 and ¾ inches and 11 inches, and preferably about 10 inches. This distance 16*d* allows the wire 16 to more smoothly pulled off the reel 12, with a minimum of friction, while at the same time allowing the wire brake 22 to more efficiently stop the wire being pulled from a reel when the pulling force is released.

Figure 4:
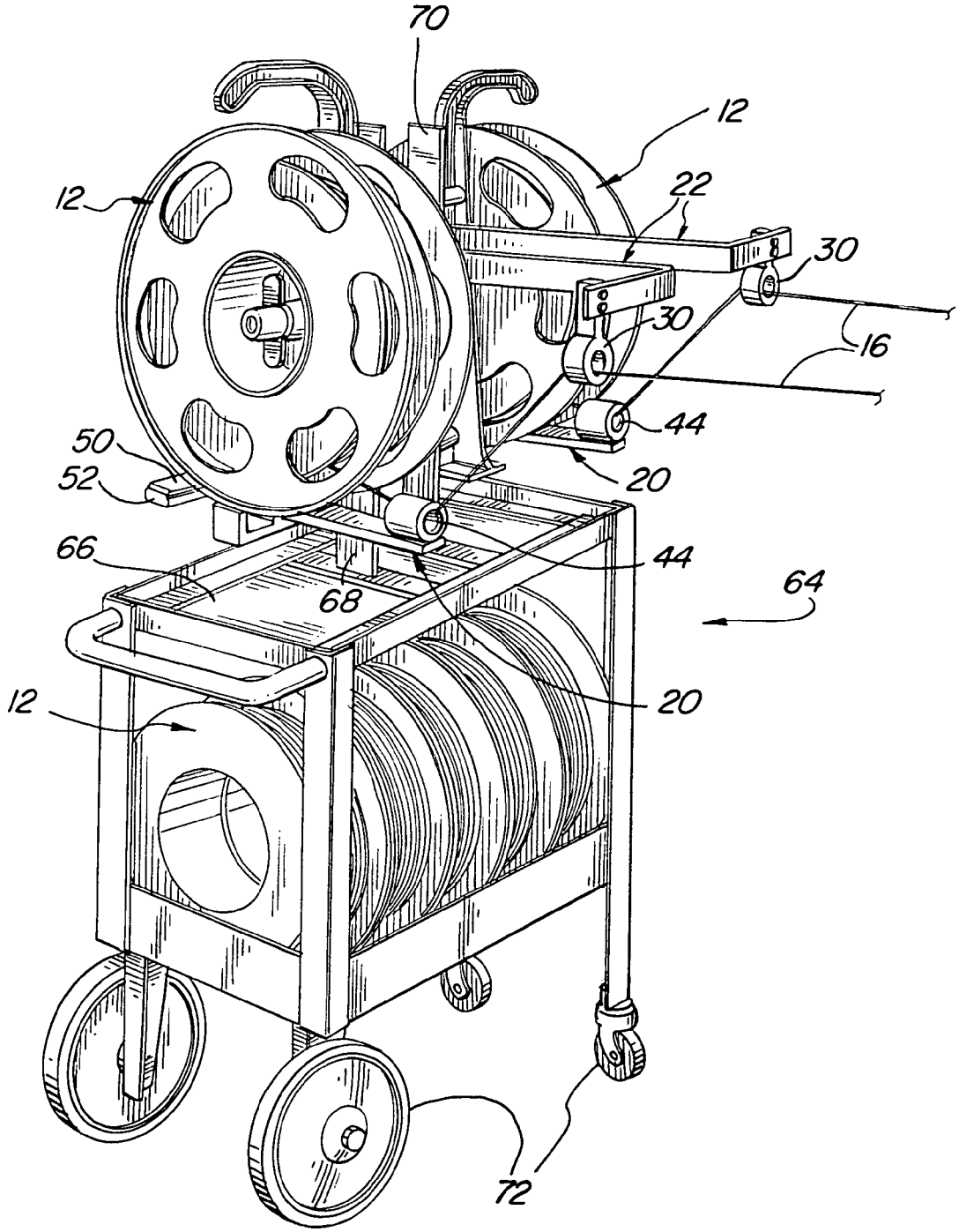
FIG. 4 is a perspective view of a cart having a plurality of wire reels with reel brakes and wire guides of the present invention mounted thereon, and a plurality of further wire reels stored therein.

Turning now to FIG. 4, there shown is a cart 64 having a plurality of wire reels 12 mounted on a top surface 66, as by means of support arms 68, 70 secured to the top surface in any desired manner, as by being welded or otherwise fastened thereto. Each of the wire reels 12 is rotatably carried or mounted on the support arms 68, 70 in any desired manner, well known to those skilled in the art. As described above, wire 16 is wrapped around a hub of each wire reel 12 and held between the sides 18 of the reels. When needed, the wire 16 is pulled from each wire reel 12 after being fed through brake arms 20 and wire guides 22 that operate in the same manner as described above.

The cart 64 preferably has wheels 72, of any desired size, to allow easy movement thereof and includes a lower storage area or tray 74 for carrying further reels 12.

Figure 5:
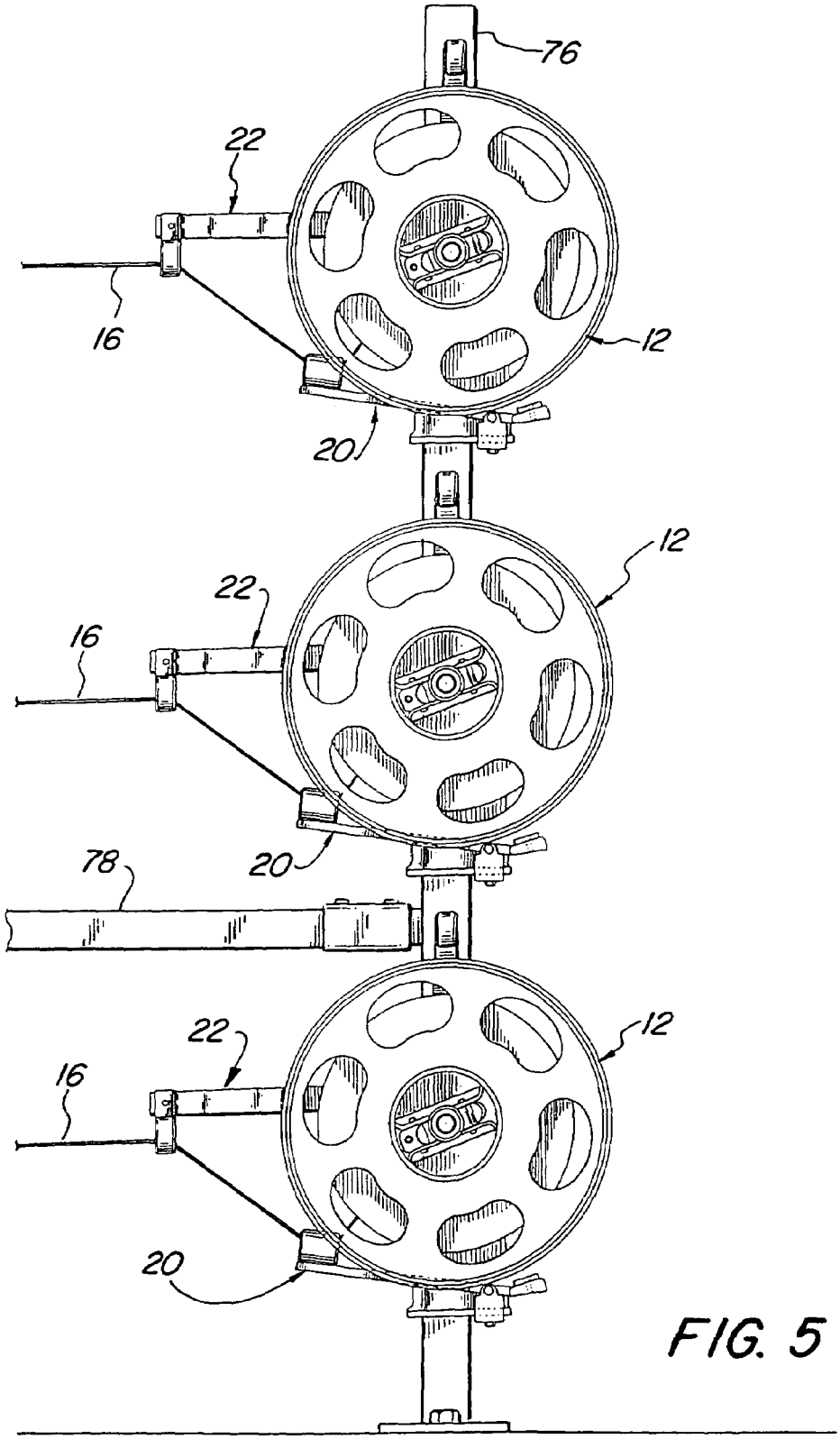
FIG. 5 is a side elevational view of a plurality of wire reel systems with reel brakes and wire guides of the present invention mounted on a support column in a telephone exchange.

FIG. 5, shows a further column or mounting means 76 for carrying or supporting a plurality of wire reels 12, such as the three (3) shown, to allow the reels to rotate to allow wire 16 to be pulled from more than one reel at a time, through separate brake arms 20 and wire guides 22 that operate in the same manner as described above. The column or mounting means 76 may be supported in any desired or known manner, as by means of a bracket or further support arm 78.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A wire reel feeding system for feeding and braking wire being pulled from a wire reel, comprising:

a support for rotatably mounting the wire reel;

a brake arm pivotably mounted on the support, the brake arm having a body with brakes for the wire reel at a first end and an enclosed eyelet formed at a second end; the enclosed eyelet adapted to receive wire from the wire reel and more efficiently brake wire being pulled from the wire reel; and a separate L-bar having an eyehook to guide wire being pulled from the wire reel through the enclosed eyelet, fixedly secured to the support against relative movement; the eyehook being aligned with the eyelet to more smoothly guide wire being pulled from the wire reel.

2. The wire reel feeding system of claim 1 wherein the brakes are comprised of a plurality of brake pads aligned with side edges of opposed sides of the wire reel, and the body includes an opening having a pivot pin held therein.

3. The wire reel feeding system of claim 2 wherein the pivot pin is rotatably held in a pair of upstanding walls secured to a base held on the support, and wherein the brake arm pivots in the base.

4. The wire reel feeding system of claim 3 wherein the eyelet is spaced from the eyehook between about 9¾" and about 11" when wire is being pulled from the wire reel through openings formed passing through the eyelet and the eyehook.

5. The wire reel feeding system of claim 4 wherein the eyelet is spaced from the eyehook about 10" when wire is being pulled from the wire reel through openings formed passing through the eyelet and the eyehook.

6. The wire reel feeding system of claim 4, further including a handle for carrying the wire reel.

7. The wire reel feeding system of claim 1 wherein there are a plurality of wire reels rotatably mounted on the support.

8. The wire reel feeding system of claim 7 wherein the support includes means for moving the support along a surface.

9. The wire reel feeding system of claim 8 wherein the support includes means for supporting a further plurality of wire reels.

10. The wire reel feeding system of claim 1 wherein the support is immovably mounted on a surface and there are a plurality of wire reels rotatably mounted on the support.

11. The wire reel feeding system of claim 10 are three wire reels rotatably mounted on the support in a single line.

12. A wire reel feeding system for feeding and braking wire being pulled from a wire reel, comprising:

a support for rotatably mounting the wire reel;

a brake arm pivotably mounted on the support; the brake arm having a body with brakes for the wire reel at a first end and an enclosed eyelet formed at a second end; wire from the wire reel being fed through the enclosed eyelet to pivot the brake arm and more efficiently brake the wire being pulled from the wire reel; and a separate L-bar having an eyehook through which the wire being pulled from the wire reel through the enclosed eyelet is fed; the separate L-bar being fixedly secured to the support against relative movement; the eyehook being aligned with the eyelet to more smoothly guide the wire being pulled from the wire reel.

13. The wire reel feeding system of claim 12 wherein the brakes are comprised of a plurality of brake pads aligned with side edges of opposed sides of the wire reel; the body includes an opening having a pivot pin held therein; the pivot pin being rotatably held in a pair of upstanding walls secured to a base held on the support; and the brake arm being pivotably held in the base.

14. The wire reel feeding system of claim 13 wherein the eyelet is spaced from the eyehook between about 9¾" and about 11" when the wire is being pulled from the wire reel through openings formed passing through the eyelet and the eyehook.

15. The wire reel feeding system of claim 14 wherein the eyelet is spaced from the eyehook about 10" when wire is being pulled from the wire reel through openings formed passing through the eyelet and the eyehook, and the wire reel has a handle for carrying the wire reel.

16. The wire reel feeding system of claim 12 wherein there are a plurality of wire reels rotatably mounted on the support.

17. The wire reel feeding system of claim 16 wherein there the support includes wheels means for moving the support along a surface and a tray for supporting a further plurality of wire reels.

18. The wire reel feeding system of claim 12 wherein the support is immovably mounted on a surface and there are three wire reels rotatably mounted on the support in a single line.

19. A wire reel feeding system for feeding and braking wire being pulled from a wire reel, comprising:

a support for rotatably mounting the wire reel;

a brake arm mounted on the support by means of a base that pivotably holds the brake arm; the brake arm having a body with a pair of brake pads for the wire reel secured to a first end and an enclosed eyelet secured at a second end; wire from the wire reel being fed through the enclosed eyelet to pivot the brake arm and more efficiently brake the wire being pulled from the wire reel; and a separate L-bar having an eyehook through which the wire being pulled from the wire reel through the enclosed eyelet is fed; the separate L-bar having a short arm and a long arm and being fixedly secured to the support by the long arm against relative movement; the eyehook being aligned with the eyelet and spaced therefrom between about 9¾" and about 11" when the wire is being pulled from the wire reel, to more smoothly guide the wire.

20. The wire reel feeding system of claim 19 wherein there are a plurality of wire reels rotatably mounted on the support.

* * * * *